US005833150A

United States Patent [19]

Koyanagi et al.

[11] Patent Number: 5,833,150

[45] Date of Patent: Nov. 10, 1998

[54] MOBILE CRUSHER AND CRUSHER CONTROL METHOD

[75] Inventors: Satoru Koyanagi, Tokyo; Yukio Tamura, Kawasaki; Toru Nakayama, Kamakura; Katsuhiro Ikegami, Kawasaki, all of Japan

[73] Assignee: Komatsu Ltd., Tokyo, Japan

[21] Appl. No.: 898,938

[22] Filed: Jul. 23, 1997

Related U.S. Application Data

[63] Continuation-in-part of PCT/JP96/00076 Jan. 19, 1996 published as WO96/22833 Jan. 8, 1996.

[30] Foreign Application Priority Data

Jan. 23, 1995 [JP] Japan ..... 7-027356

[51] Int. Cl.[6] ..... B02C 21/02; B02C 25/00

[52] U.S. Cl. ..... 241/27; 241/34; 241/35; 241/101.74

[58] Field of Search ..... 241/33, 34, 35, 241/36, 27, 101.74, 265

[56] References Cited

U.S. PATENT DOCUMENTS

| | | | |
|---|---|---|---|
| 3,078,051 | 2/1963 | Patterson | 241/35 |
| 3,459,378 | 8/1969 | Hill | 241/35 |
| 4,267,981 | 5/1981 | Rowland, Jr. | 241/30 |
| 4,635,858 | 1/1987 | Welch et al. | 241/16 |
| 4,804,148 | 2/1989 | Etheridge | 241/35 |
| 5,580,004 | 12/1996 | Tamura et al. | 241/36 |
| 5,716,014 | 2/1998 | Tamura et al. | 241/36 |
| 5,730,373 | 3/1998 | Tamura et al. | 241/34 |

FOREIGN PATENT DOCUMENTS

| | | |
|---|---|---|
| 1-247604 | 10/1989 | Japan . |
| 5-161856 | 6/1993 | Japan . |
| 5-168970 | 7/1993 | Japan . |
| 5-184968 | 7/1993 | Japan . |
| 7-13443 | 3/1995 | Japan . |
| 7-116541 | 5/1995 | Japan . |
| 8-257425 | 10/1996 | Japan . |
| 9622833 | 8/1996 | WIPO . |

*Primary Examiner*—John M. Husar
*Attorney, Agent, or Firm*—Sidley & Austin

[57] ABSTRACT

The present invention is a mobile crusher and a method for controlling the same, wherein the most suitable amount of crushed substances can be always secured so as to obtain crushed substances having a desired particle size distribution. To this end, the crusher mechanism includes an actual rotational speed changing means (1, 2, 3); an actual rotational speed detecting means (4); a rotational speed setting means (7) for setting at least one target rotational speed Nm for the crusher mechanism (13) and for setting, for each target rotational speed Nm, a rotational speed Na indicating a starting of supplying raw materials and a rotational speed Nb indicating a stopping of the supplying of raw materials; and a control means (6) for controlling the crusher mechanism such that an actual rotational speed N coincides with the target rotational speed Nm, starting the supplying of raw materials from a raw material supply device (14) when the actual rotational speed N increases to a rotational speed Na, and stopping the supplying of raw materials when the actual rotational speed N decreases to the rotational speed Nb.

14 Claims, 5 Drawing Sheets

MOBILE CRUSHER AND CRUSHER CONTROL METHOD

RELATED APPLICATION

This application is a continuation-in-part application of copending International Application PCT/JP96/00076, which designated the U.S., which has an international filing date of Jan. 19, 1996, published as WO96/22833 Jan. 8, 1996 and which claims priority to Japanese Patent Application 7-27356, filed on Jan. 23, 1995.

FIELD OF THE INVENTION

The present invention relates to a mobile crusher, which crushes materials with a crusher mechanism, and to a crusher control method.

BACKGROUND OF THE INVENTION

An example of a mobile crusher, which is illustrated in FIG. 9, is equipped with a mobile carriage 12, a crusher mechanism 13, a raw material supply device 14, a belt conveyer 15, and an engine (not shown) which serves as a direct and common driving source for the crusher mechanism 13, the raw material supply device 14, and the belt conveyor 15. Raw materials, such as natural stones, concrete lumps, asphaltic lumps, etc., are supplied from the hopper 14*a* of the raw material supply device 14 and are crushed within the crusher mechanism 13; and the resulting crushed substances are conveyed to the outside by the belt conveyer 15.

There are various kinds of crusher mechanisms 13. For example, an impact crusher mechanism is illustrated in FIG. 10 and is configured by mounting a rotor 134, having a plurality of impact blades 133 on its outer perimeter, within a container 132, which is provided with at least one repulsion plate 131 mounted on an inner wall of the container 132. By rotating the rotor 134, the raw materials supplied from the raw material supply device 14 (specifically, from a hopper 142 via a feeder 141 for introducing a determined amount) are forced against the repulsion plate 131 by the rotating impact blades 133 and are crushed. Accordingly, the impact crusher mechanism has a characteristic that the faster the rotational speed N of the crusher mechanism 13 (more particularly, the rotor 134) becomes, the finer the particle size distribution becomes if the amount of the raw material supplied is the same.

By utilizing the above-described characteristic, the crusher mechanism 13 can be operated to produce crushed substances of a desired particle size distribution by maintaining a constant rotational speed N. However, if large lumps and very hard substances are mixed in the raw materials, the rotational speed N is varied, even if the amount of the raw materials supplied is the same. By regulating the rotational speed of the engine, the variation in the rotational speed N can be reduced. However, if especially large lumps or especially hard substances are mixed in the raw materials, the rotational speed N is greatly decreased, and not only is it impossible to obtain crushed substances of a desired particle size distribution, but also the crusher mechanism 13 can be damaged. As a measure against the damage problem, it has been proposed to automatically stop the raw material supply device 14 when the rotational speed N of the crusher mechanism 13 is reduced to a specified rotational speed Nb, and to automatically start the raw material supply device 14 when the rotational speed N is increased to a specified rotational speed Na (see, for example, Japanese Patent Application No. 5-266522).

However, the above-described proposition has the following disadvantages.

(1) A variation in the rotational speed of the crusher mechanism 13 affects the engine rotational speed. As a result, when the rotational speed of the crusher mechanism 13 is varied, the driving speed of the raw material supply device 14 and the belt conveyer 15, which have the same driving source as the crusher mechanism 13, are also varied. When the driving speeds of the raw material supply device 14 and the belt conveyer 15 are varied by the load, the rotational speed of the crusher mechanism 13 is also varied by the resulting variation in the rotational speed of the engine. As a result, there exists the disadvantages that the crushing efficiency is reduced, and that the obtained particle size distribution varies greatly.

(2) Only one pair of specified rotational speeds Na and Nb is set for the rotational variation of the crusher mechanism 13 when the raw material supply device 14 is automatically started or stopped. Therefore, when the engine speed (specifically, the target rotational speed Nm of the crusher mechanism 13) is set higher to obtain crushed substances of a fine particle size distribution, the difference from the rotational speed Nb is increased (specifically, the permissible range of the rotational variation of the crusher mechanism 13 is expanded), so that obtaining a fine particle size distribution is difficult. On the other hand, when the engine rotational speed (specifically, the target rotational speed Nm) is set lower, the difference from the rotational speed Nb is decreased (specifically, the permissible range of the rotational variation of the crusher mechanism 13 becomes narrow), the rotational speed N of the crusher mechanism 13 easily becomes a set value Nb, and the raw material supply device 14 is easily stopped. Thus, there is a disadvantage of reducing the crushing efficiency. Since a target rotational speed Nm less than a specified rotational speed Nb cannot be set, there is also a disadvantage of being unable to obtain crushed substances of a particle size distribution corresponding to the target rotational speed Nm.

SUMMARY OF THE INVENTION

The present invention is made to eliminate the above described disadvantages, and its object is to provide a mobile crusher and a crusher control method by which crushed substances of a wide range of desired particle size distribution can be obtained, and the most suitable amount of crushed substances can be secured.

The mobile crusher according to the present invention is a mobile crusher, which is equipped with a raw material supply device and a crusher mechanism mounted on a mobile carriage and which uses the crusher mechanism to crush raw materials supplied from the raw material supply device, and is characterized by:

an actual rotational speed changing means, for changing an actual rotational speed N of the crusher mechanism;

an actual rotational speed detecting means, for detecting the actual rotational speed N;

a rotational speed setting means, for setting at least one target rotational speed Nm of the crusher mechanism, and for setting, for each target rotational speed Nm, a rotational speed Na of the crusher mechanism indicating the starting of the supplying of the raw materials, and a rotational speed Nb of the crusher mechanism indicating the cessation of the supplying of the raw materials; and a control means;

the control means controlling the actual rotational speed changing means so that the detected actual rotational speed N coincides with the target rotational speed Nm when the crusher mechanism is rotated at the target rotational speed Nm which has been set, the control means starting the supplying of the raw materials from the raw material supply device when the actual rotational speed N is increased to the rotational speed Na, and the control means stopping the supplying of the raw materials from the raw material supply device when the actual rotational speed N is decreased to the rotational speed Nb.

The crusher control method according to the present invention is a method for controlling a crusher mechanism to crush raw materials supplied from a raw material supply device, and is characterized by the steps of:

for each target rotational speed Nm which is set, setting a rotational speed Na of the crusher mechanism indicating the starting of the supplying of the raw materials and a rotational speed Nb of the crusher mechanism indicating the cessation of raw material supply;

controlling the actual rotational speed N so that the actual rotational speed N of the crusher mechanism coincides with the target rotational speed Nm when the crusher mechanism is rotated at the target rotational speed Nm which has been set;

starting the supplying of raw materials from the raw material supply device when the actual rotational speed N is increased to the rotational speed Na; and stopping raw materials supply from the raw material supply device when the actual rotational speed N is decreased to the rotational speed Nb;

thereby obtaining crushed substances of a desired particle size distribution.

According to the above-described structure of the present invention, a desired particle size distribution for crushed substances is initially determined when the crusher is, for example, an impact crusher. Then the target rotational speed Nm of the crusher mechanism which generates the particle size distribution is determined. Next, the target rotational speed Nm is set at the control means by the rotational speed setting means. At the same time of this setting, the rotational speed Na, indicating the starting of the supplying of the raw materials corresponding to the target rotational speed Nm, and the rotational speed Nb, indicating the cessation of the supplying of the raw materials, are set at the control means. Then the control means controls the actual rotational speed changing means so that the actual rotational speed N which is received from the actual rotational speed detecting means coincides with the target rotational speed Nm when the crusher mechanism is rotated. With this control, when the actual rotational speed N is increased to the rotational speed Na, the control means starts the supplying of the raw materials from the raw material supply device and crushes the raw materials. However, if especially large lumps or especially firm objects are in the raw materials, the actual rotational speed N is decreased. When the actual rotational speed N is decreased to the rotational speed Nb, the supplying of the raw materials from the raw material supply device is stopped, thereby reducing the load on the crusher mechanism, and increasing the actual rotational speed N again. When the actual rotational speed N becomes the rotational speed Na, the supplying of the raw materials from the raw material supply device is started again to start crushing the raw materials again. By repeating the above-described steps, crushed substances of a desired particle size distribution can be steadily produced.

As particularly described below, if the crusher mechanism is, for example, a jaw crusher mechanism, and if the raw materials are easily crushed, such as concrete, or the like, the amount of the crushed substances can be increased by setting the target rotational speed Nm at a high speed level by the rotational speed setting means. On the other hand if the raw materials contain firm objects, such as rough stones, asphalt, or the like, the slide abrasion of the crusher mechanism and the heat generation can be curbed and the amount of crushed substances can be increased by setting the target rotational speed Nm at a low speed level by the rotational speed setting means.

BEST MODE FOR CARRYING OUT THE INVENTION

A preferred embodiment of a mobile crusher and a crusher control method relating to the present invention will be particularly described with reference to the attached drawings.

Figure 1:
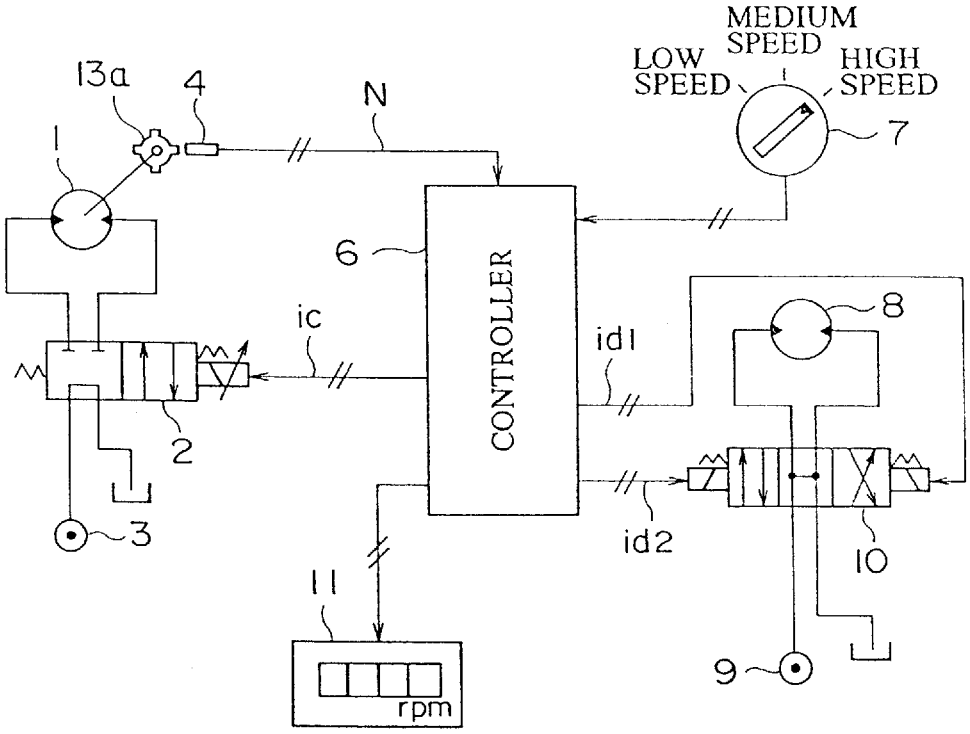
FIG. 1 is a fragmentary block diagram.
Figure 9:
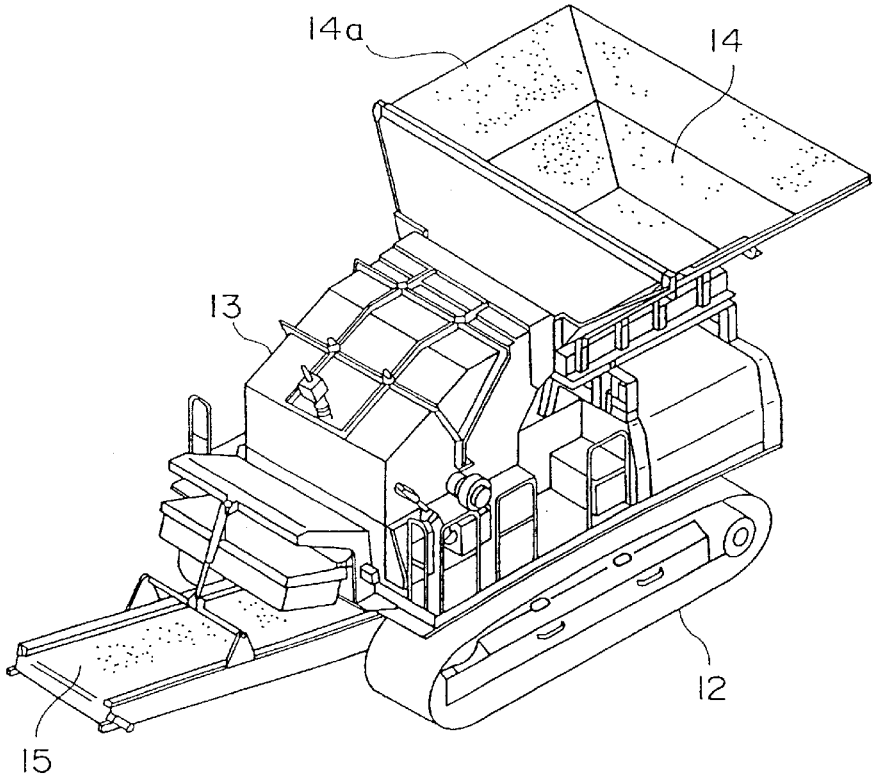
FIG. 9 CONVENTIONAL ART
FIG. 9 is a perspective view of a mobile crusher according to the conventional art.
Figure 10:
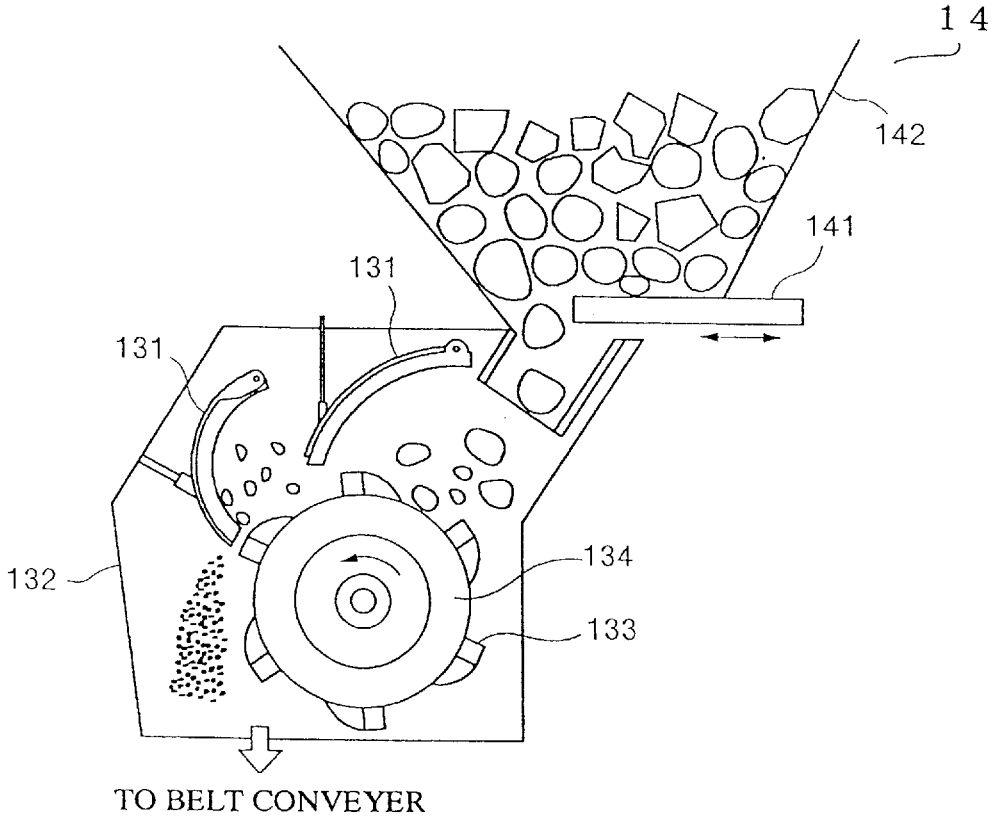
FIG. 10 CONVENTIONAL ART
FIG. 10 is a side view of an impact crusher mechanism relating to the conventional art.

In FIG. 1, a crusher mechanism 13 (refer to FIG. 9) is, for example, an impact crusher mechanism, and includes a hydraulic oil motor 1, a flow control valve 2, and a hydraulic oil source 3. The flow control valve 2 is provided in a hydraulic oil circuit from the hydraulic oil source 3 to the hydraulic oil motor 1, so as to receive a command value ic from a controller 6, defined by a microcomputer or the like, to turn on the flow of the hydraulic oil to the hydraulic oil motor 1. The flow control valve 2 passes a flow, which is proportional to the numerical value of the command value ic, to the hydraulic oil motor 1 to rotate the hydraulic oil motor 1 at a free speed. Specifically, the actual rotational speed changing means is defined by the hydraulic oil motor 1, the flow control valve 2, and the hydraulic oil source 3 in the present embodiment.

A rotational speed detecting means (actual rotational speed detecting means) 4 is provided in the vicinity of a rotating element 13*a* which has radial projections and is mounted on the rotational shaft of the hydraulic oil motor 1; and a rotating condition (namely, the rotating condition of the crusher mechanism 13) of the hydraulic oil motor 1 is detected by the rotational speed detecting means 4 and is inputted into the controller 6. The controller 6 converts the rotating condition into a rotational speed N.

A raw material supply device 14 includes a hydraulic oil motor 8, a flow control valve 10, and a hydraulic oil source 9 (this can be the above-described hydraulic oil source 3 or a different source). The flow control valve 10 is provided in a hydraulic oil circuit from the hydraulic oil source 9 to the hydraulic oil motor 8, and the flow of hydraulic oil to the hydraulic oil motor 8 can be turned on by the flow control valve 10 receiving a command value id1 from the controller 6. The flow control valve 10 sends a flow, which is proportional to the numerical value of the command value id1, to the hydraulic oil motor 8 to rotate the hydraulic oil motor 8 at a free speed. Specifically, the raw materials are supplied from an open portion at the lower portion of the hopper 14*a* of the raw material supply device 14 to the crusher mechanism 13 correspondingly to the vibration associated with the rotational speed of the hydraulic oil motor 8. The flow control valve 10 of the embodiment can reversely rotate the hydraulic oil motor 8 at a free speed by receiving a command value id2 from the controller 6.

The controller 6 includes a rotational speed setting means 7. The rotational speed setting means 7 is used when an operator is to input into the controller 6 a target rotational speed Nm of the crusher mechanism 13 corresponding to a desired particle size distribution of crushed substances. The rotational speed setting means 7 of the embodiment can set the target rotational speed Nm at three levels of speed: low, medium, and high. The target rotational speed Nm can be set at any number of different levels or at one standardized level.

The rotational speed setting means is a means for setting (a) the target rotational speed Nm, (b) a rotational speed Na of the crusher mechanism 13 which is an indicator for starting the supplying of the raw materials at each target rotational speed Nm (i.e., indicating the start of the rotation of the hydraulic motor 8), and (c) a rotational speed Nb of the crusher mechanism 13 which is an indicator for stopping the supplying of the raw materials (i.e., indicating the cessation of the rotation of the hydraulic motor 8). If an operator inputs a specified target rotational speed Nm into the controller 6 through the medium of the rotational speed setting means 7, and, at the same time, sets the rotational speeds Na and Nb corresponding to the target rotational speed Nm through the medium of the rotational speed setting means 7, the rotational speed setting means is defined by the rotational speed setting means 7 itself.

On the other hand, when a matrix or an operational expression for drawing the rotational speeds Na and Nb for every target rotational speed Nm is previously memorized by the controller 6, the operator only has to select the target rotational speed Nm at the rotational speed setting means 7. In this case, the controller 6, referring to the thus selected target rotational speed Nm, extracts or calculates the corresponding rotational speeds Na and Nb from the memory. Accordingly, the rotational speed setting means in this case is defined by the rotational speed setting means 7 and the controller 6. The present embodiment has a structure for calculating the rotational speeds Na and Nb for the latter case.

Figure 2:
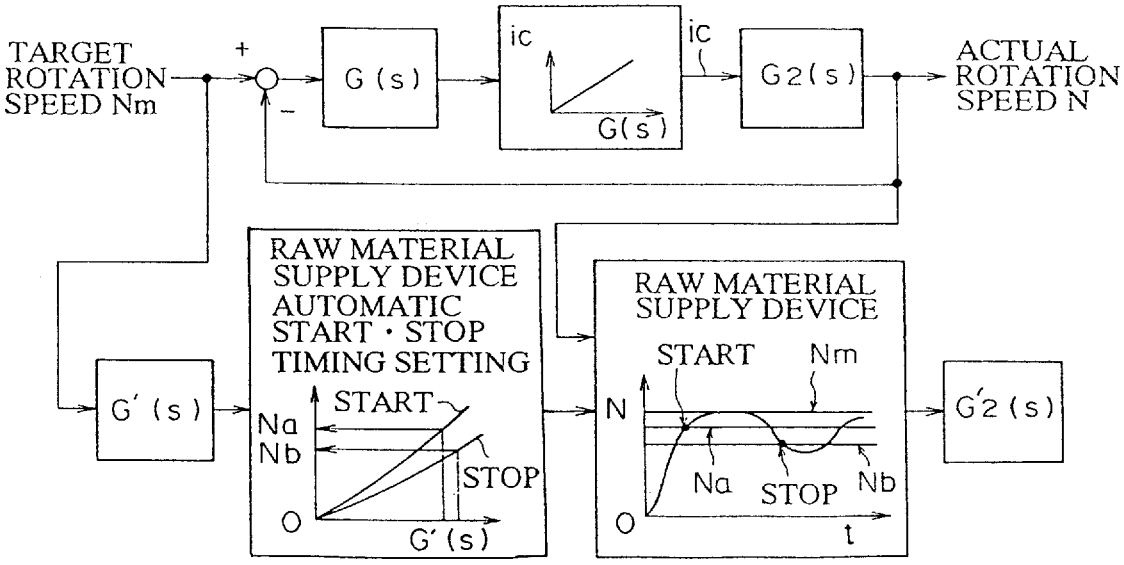
FIG. 2 is a block diagram of a control in an embodiment of the invention.

Next, the first control example by the controller 6 will be particularly explained with reference to FIG. 2 and the timing charts of the actual rotational speed N with the starting and the stopping of the raw material supply device in FIGS. 3 to 5.

Figure 3:
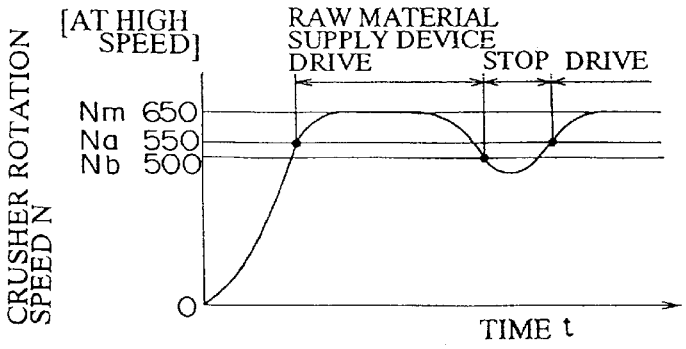
FIG. 3 is a timing chart in a case where the target rotational speed Nm is a high speed in a first control example according to the embodiment.

When crushed substances of a fine particle size distribution are desired, an operator switches the rotational speed setting means 7 to a high speed position as illustrated in FIG. 3. The controller 6 has the target rotational speed Nm (=650 rpm) inputted, and calculates the corresponding rotational speeds Na (=550 rpm) and Nb (=500 rpm).

Figure 4:
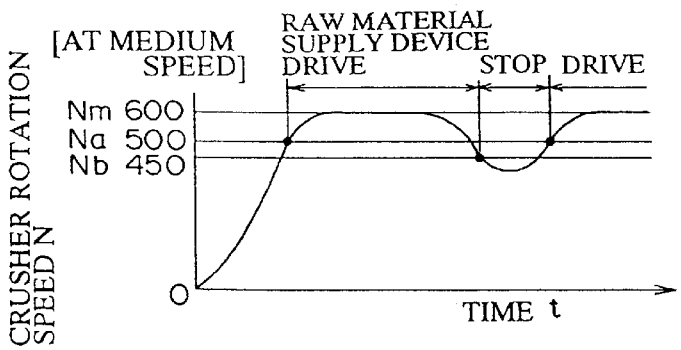
FIG. 4 is a timing chart in a case where the target rotational speed Nm is a medium speed in the first control example.

When crushed substances of an ordinary particle size distribution are desired, the rotational speed setting means 7 is switched to a medium speed position as illustrated in FIG. 4. The controller 6 has the target rotational speed Nm (=600 rpm) inputted, and calculates the corresponding rotational speed Na (=500 rpm) and rotational speed Nb (=450 rpm).

Figure 5:
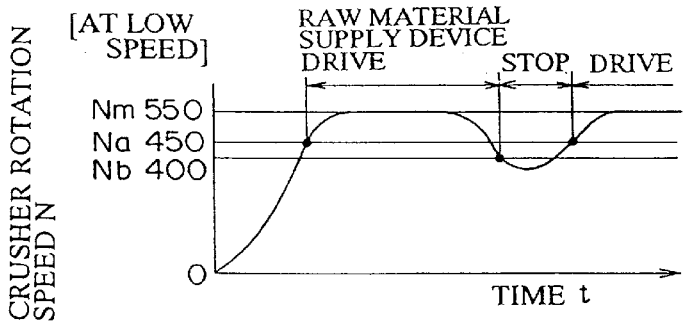
FIG. 5 is a timing chart in a case where the target rotational speed Nm is a low speed in the first control example.

Further, when crushed substances of a coarse particle size distribution are desired, the rotational speed setting means 7 is switched to a low speed position as illustrated in FIG. 5. The controller 6 has the target rotational speed Nm (=550 rpm) inputted and calculates the corresponding rotational speed Na (=450 rpm) and rotational speed Nb (=400 rpm).

When an operator conducts a crusher actuating operation, the controller 6, which has received the actuating signal, inputs a command value ic corresponding to the target rotational speed Nm into the flow control valve 2 and rotates the crusher mechanism 13. The controller 6 always has a current rotating condition of the crusher mechanism 13 inputted by the rotational speed detecting means 4, and when the controller 6 determines that the actual rotational speed N is increased up to the rotational speed Na, the controller 6 outputs a specified command value id1 to the flow control valve 10 to rotate the hydraulic oil motor 8. Specifically, raw materials are supplied into the crusher mechanism 13, and the crushing thereof is started. Thereafter, the command value ic, which makes the variation between the actual rotational speed N and the target rotational speed Nm to be zero, is calculated and is inputted into the flow control valve 2, thereby controlling the variation of the actual rotational speed N.

When an extremely large cluster or especially solid objects are included in the raw materials during a crushing operation, the actual rotational speed N is reduced even during the above-described control. When the actual rotational speed N is reduced to be the rotational speed Nb, the controller 6 outputs a command value id1 to the flow control valve 10 to switch the flow control valve 10 to a neutral position and cut off the circuit to the hydraulic oil motor 8, thereby automatically stopping the hydraulic oil motor 8. Specifically, the supplying of the raw materials is stopped. Thereafter, when the actual rotational speed N is recovered (specifically, is increased) to be the rotational speed Na, the controller 6 outputs a command value id1 to the flow control valve 10 to switch the flow control valve 10 to an open position. As a result, the circuit to the hydraulic oil motor 8 is opened to automatically actuate the hydraulic oil motor 8, raw materials are supplied, and the crushing of the raw materials is started again.

Although the target rotational speed Nm in the above described embodiment has a specified value (650 rpm, 600 rpm, 550 rpm), the target rotational speed Nm can have a specified width (for example, 650±15 rpm, 600±15 rpm, 550±15 rpm). As for the hydraulic oil motor 8, any actuator is suitable so long as it drives the raw material supply device 14.

According to the above-described first control example, the maintenance and control of the target rotational speed Nm for the crusher mechanism 13 can be carried out independently from the rotational control of the hydraulic oil motor 8 and the belt conveyer 15; therefore, even if the rotational speed of the crusher mechanism 13 is varied, the driving speeds of the raw material supply device 14 and the belt conveyer 15 are not varied. On the other hand, even if the driving speeds of the raw material supply device 14 and the belt conveyer 15 are varied, the rotational speed of the crusher mechanism 13 is not varied, so that the crushing efficiency is not reduced.

In addition, even if the target rotational speed Nm is changed, the most suitable actuating and stopping times of the raw material supply device 14 can be freely set correspondingly to each target rotational speed Nm; therefore, crushed substances of a desired particle size distribution can be obtained. By extension, damages to the crusher mechanism 13 can be eliminated.

Next, a second control example will be explained with reference to FIGS. 2 and 6.

The first control example is a control example based on the prediction that the raw material supply device only supplies a fixed amount of raw materials, in which the flow control valve 10 is simply opened and closed (ON-OFF). Contrary to the above, the second control example is a control example in which the crushing is carried out with higher efficiency by additionally controlling the flow control valve 10 as a proportional control valve. Thus, in the second control example the flow control valve 10 is a proportional control valve and is actuated proportionally to the commands id1 and id2.

Figure 6:
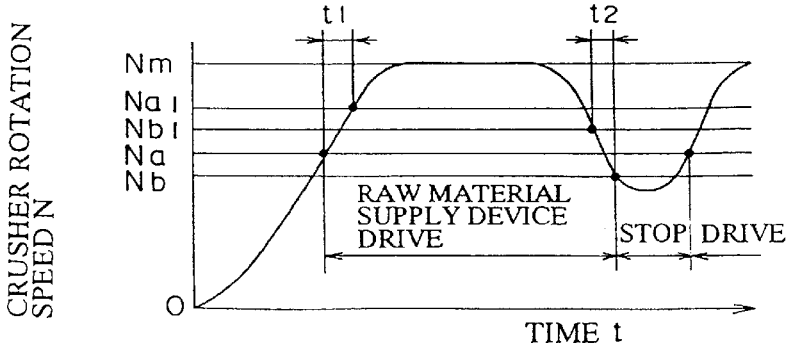
FIG. 6 is a timing chart of a second control example according to the embodiment.

Specifically, as illustrated in FIG. 6, the controller 6 can freely set, for every target rotational speed Nm of the crusher mechanism 13, a setting value Na1, which rotates the hydraulic oil motor 8 at a specified rotational speed, and a setting value Nb1, which rotates the hydraulic oil motor 8 more slowly than the specified rotational speed. In the second control example, the hydraulic oil motor 8 is set to rotate more slowly than the specified rotational speed when the actual rotational speed N of the crusher mechanism 13 is increased to be the rotational speed Na. In this way, the amount of the raw materials being supplied is decreased in a period t1 from the rotational speed Na to the rotational speed Na1 and in a period t2 from the rotational speed Nb1 to the rotational speed Nb. As a result, in the period t1, the actual rotational speed N quickly becomes the target rotational speed Nm. In the period t2, it is difficult for the actual rotational speed N to become the rotational speed Nb (specifically, the target rotational speed Nm is easily maintained). A low speed control of the above-described rotational speed of the hydraulic oil motor 8 in these periods t1 and t2 can be attained by changing the numerical value of the command value id1 inputted into the flow control valve 10 by the controller 6.

The above-described second control example has a synergetic effect in that the target rotational speed Nm is more easily maintained and the possibilities of automatically stopping the supplying of the raw materials is reduced. Accordingly, crushed substances of more suitable particle size distribution can be obtained. In addition, the possibility of the crusher mechanism 13 breaking is further reduced.

Figure 7:
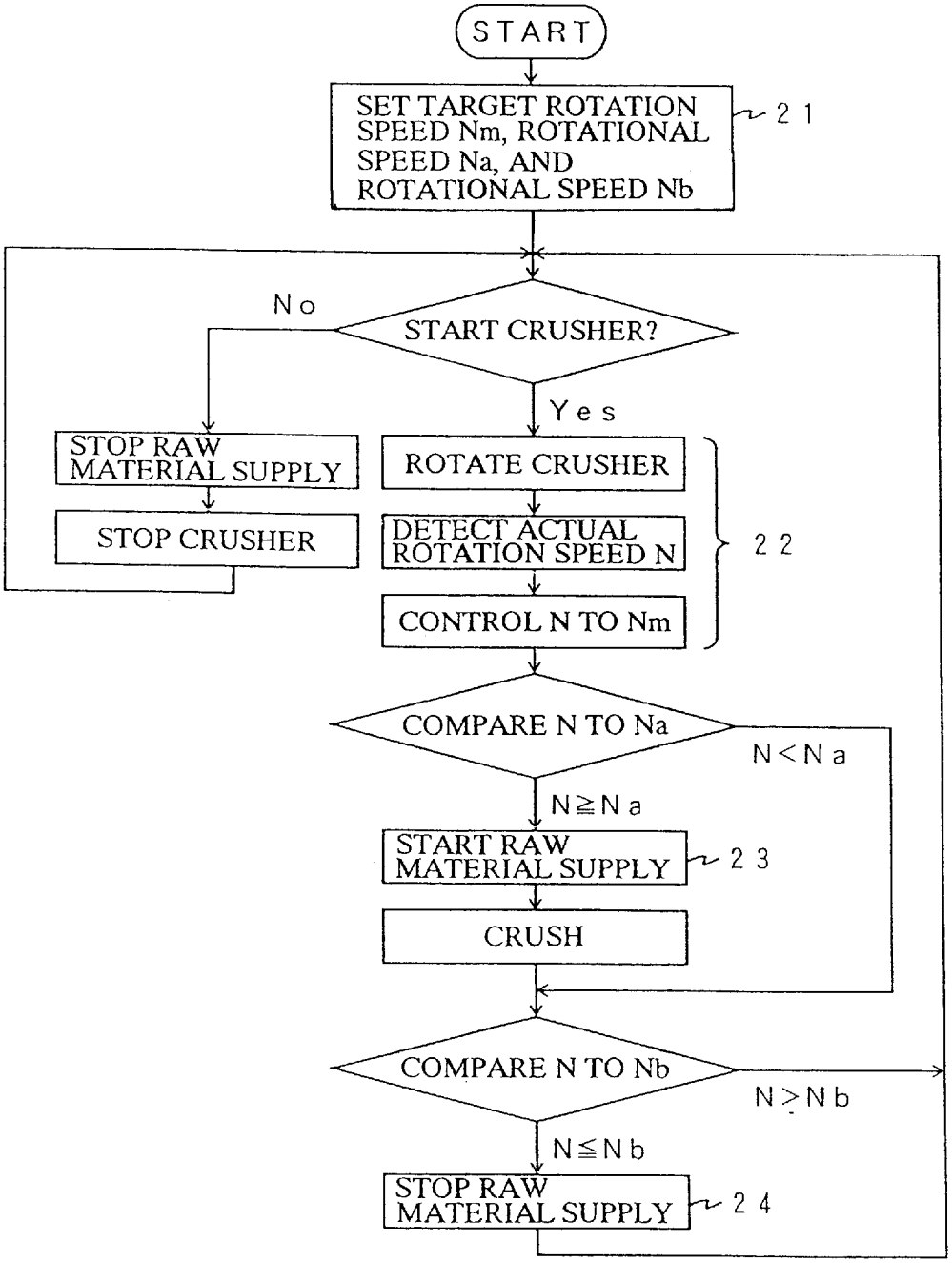
FIG. 7 is a flow chart of the first and second control examples.

The steps in FIG. 7 showing the above-described first control example and the second control example are:

(a) the rotational speed Na, indicating the starting of the supplying of the raw materials, and the rotational speed Nb, indicating the cessation of the supplying of the raw materials, are set for every target rotational speed Nm which has been set (Step 21), (b) when the crusher mechanism 13 is rotated at the target rotational speed Nm which has been set, the actual rotational speed N is controlled so that the actual rotational speed N coincides with the target rotational speed Nm (Step 22), and (c) when the actual rotational speed N is increased to be the rotational speed Na, the supplying of the raw materials from the raw material device 14 is started (Step 23), whereas (d) the supplying of the raw materials from the raw material supply device 13 is stopped when the actual rotational speed N is reduced to be the rotational speed Nb (Step 24). These steps enable obtaining crushed substances of a desired particle size distribution.

Figure 8:
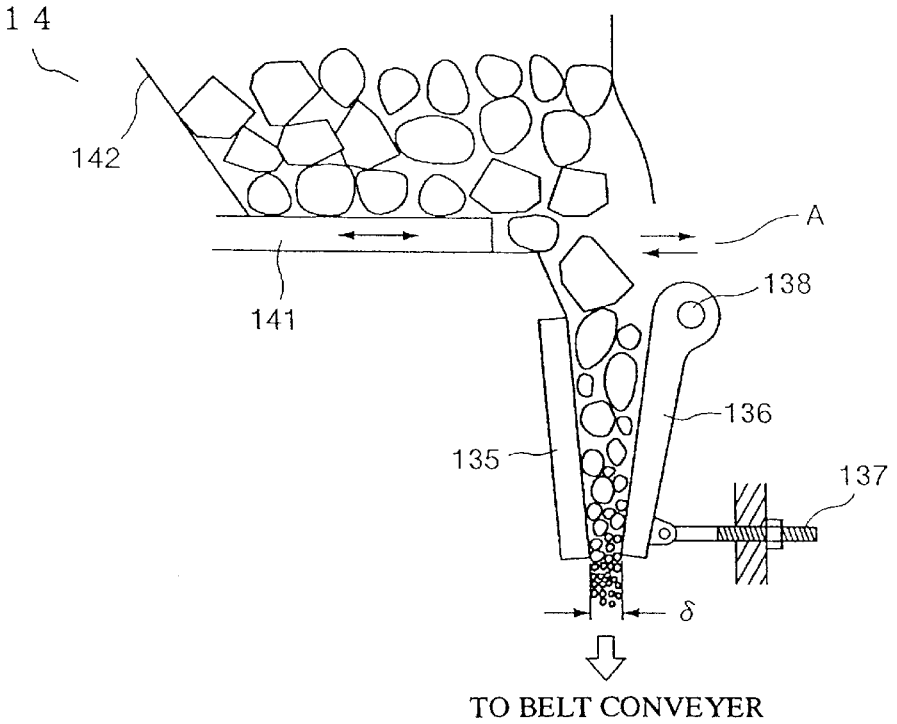
FIG. 8 is a side view of a jaw crusher mechanism for explaining a third control example relating to the embodiment.

Next a third control example will be described with reference to FIG. 8. The third control example is suitable for a machine in which the crusher mechanism 13 is a jaw crusher mechanism. A jaw crusher mechanism is made by a fixed jaw 135 and a swing jaw 136 which are opposed to each other with their bottom ends being narrowly separated from each other and their top ends being widely separated from each other. The bottom end of the swing jaw 136 can be freely regulated by a regulating means 137 to be far from or near to the fixed jaw 135. On the other hand, the top end of the swing jaw 136 is connected to an eccentric shaft 138, which is rotated by the hydraulic oil motor 8 (refer to FIG. 1), and is driven in the directions of the arrows A to be cyclicly far from and then near to the fixed jaw 135.

Accordingly, when the raw materials supplied from the raw material supply device 14 (specifically, the hopper 142 through the medium of the feeder 141 for inputting a fixed amount) are inputted from the opening of the top portion of the jaw crusher mechanism (specifically, the upper end space between the fixed jaw 135 and the swing jaw 136), the raw materials are crushed by the reciprocating movement A of the swing jaw 136. The particle diameter of the raw materials becomes smaller as the raw materials move downwardly through the jaw crusher mechanism and falls from the opening in the bottom portion of the jaw crusher mechanism (specifically, the bottom end space δ between the fixed jaw 135 and the swing jaw 136) onto the conveyor belt. The particle size of the crushed substances depends on the space δ, and is regulated from the outside by the regulating means 137. The cyclicly far and near drive in the directions of the arrows A of the swing jaw 136 is included in the term "rotation". Therefore, the "far and near drive" is referred hereinafter as "rotation".

A jaw crusher mechanism has a characteristic that the crushing amount is increased as a result of increasing the rotational speed when the raw materials are easily crushed, like concrete or the like. However, a jaw crusher mechanism is in a wedge form with the upper portion of the space being widened so that rough stones can pass through the upper portion; and when rough stones are crushed, a force moving the rough stones upwardly acts on the rough stones and the crusher mechanism; therefore, slide abrasion is caused by the rough stones. Accordingly, if the rotational speed is increased when the raw materials are firm like rough stones, or the like, the jaw crusher mechanism has a characteristic that the amount of slide abrasion is increased and that the crushing amount is reduced. If the raw materials have a viscosity affected by heat, as asphalt or the like, when the rotational speed is increased, the jaw crusher mechanism generates heat as a result of the frictional forces created when crushing the raw materials, thereby affecting the viscosity of the raw materials, so that the jaw crusher mechanism has a characteristic that the crushing amount is reduced.

Accordingly, when the crusher mechanism 13 is a jaw crusher mechanism, the target rotational speed Nm is initially determined in accordance with the nature of the raw materials. When raw materials are used which are easily crushed, like concrete, etc., the crushing amount can be increased by switching the rotational speed setting means 7 to a high speed position (or a high speed side). On the other hand, when the raw materials used are firm materials such as rough stones, asphalt or the like, the crushing amount can be increased, while curbing abrasion and heat generation, by switching the rotational speed setting means 7 to a low speed position (or a low speed side).

As illustrated in FIG. 1, it is desirable that the controller 6 includes a rotational speed display device 11 for the crusher mechanism 13. In this way, an operator can always keep track of the actual rotational speed N by the rotational speed display device 11. In addition, by visually checking the particle size distribution of the crushed substances, a more suitable target rotational speed Nm and the corresponding rotational speeds Na, Nb, Na1, and Nb1 can be set again; therefore, crushed substances of more suitable particle size distribution are easily obtained.

INDUSTRIAL APPLICABILITY

The present invention is useful as a mobile crusher and a crusher control method by which a wide range of desired particle size distribution can be obtained and the most suitable amount of crushed substances can be always secured.

We claim:

1. A crusher apparatus comprising:

a raw material supply device;

a crusher mechanism mounted so that said crusher mechanism can crush raw materials which are supplied from said raw material supply device;

an actual speed changing means, for changing an actual speed N of said crusher mechanism;

an actual speed detecting means, for detecting said actual speed N;

a speed setting means, for setting at least one target speed Nm of said crusher mechanism, and for setting for each thus set target speed Nm a speed Na, of said crusher mechanism indicating a starting of supplying raw materials to said crusher mechanism, and a speed Nb, of said crusher mechanism indicating a stopping of supplying raw materials to said crusher mechanism; and a control means, said control means controlling said actual speed changing means so that said detected actual speed N coincides with said target speed Nm when said crusher mechanism is operated at a target speed Nm which has been set, said control means starting a supplying of raw materials from said raw material supply device when said actual speed N is increased to said speed Na, and said control means stopping a supplying of raw materials from said raw material supply device when said actual speed N is reduced to said speed Nb.

2. A crusher apparatus in accordance with claim 1, wherein said speed setting means is capable of setting a plurality of target speeds Nm of said crusher mechanism, and of setting a speed Na and a speed Nb for each of said plurality of target speeds Nm, and wherein said speed setting means permits an operator to select any one of said plurality of target speeds Nm.

3. A mobile crusher apparatus in accordance with claim 2, wherein said crusher mechanism comprises an impact crusher mechanism.

4. A mobile crusher apparatus in accordance with claim 2, wherein said crusher mechanism comprises a jaw crusher mechanism.

5. A mobile crusher apparatus comprising:

a mobile carriage;

a raw material supply device;

a crusher mechanism, said crusher mechanism and said raw material supply device being mounted on said mobile carriage so that said crusher mechanism can crush raw materials which are supplied from said raw material supply device;

an actual rotational speed changing means, for changing an actual rotational speed N of said crusher mechanism;

an actual rotational speed detecting means, for detecting said actual rotational speed N;

a rotational speed setting means, for setting at least one target rotational speed Nm of said crusher mechanism, and for setting, for each thus set target rotational speed Nm, a rotational speed Na, of said crusher mechanism indicating a starting of supplying raw materials, and a rotational speed Nb, of said crusher mechanism indicating a stopping of supplying raw materials; and a control means, said control means controlling said actual rotational speed changing means so that said detected actual rotational speed N coincides with said target rotational speed Nm when said crusher mechanism is rotated at a thus set target rotational speed Nm, said control means starting a supplying of raw materials from said raw material supply device when said actual rotational speed N is increased to said rotational speed Na, and said control means stopping a supplying of raw materials from said raw material supply device when said actual rotational speed N is reduced to said rotational speed Nb.

6. A mobile crusher apparatus in accordance with claim 5, wherein said speed setting means is capable of setting a plurality of target rotational speeds Nm of said crusher mechanism, and of setting a rotational speed Na and a rotational speed Nb for each of said plurality of target rotational speeds Nm, and wherein said speed setting means permits an operator to select any one of said plurality of target rotational speeds Nm.

7. A mobile crusher apparatus in accordance with claim 6, wherein said crusher mechanism comprises an impact crusher mechanism.

8. A mobile crusher apparatus in accordance with claim 6, wherein said crusher mechanism comprises a jaw crusher mechanism.

9. A method for controlling a crusher mechanism which crushes raw materials supplied from a raw material supply device, said method comprising the steps of:

setting at least one target speed Nm;

setting, for each target speed Nm which is set, a speed Na of said crusher mechanism indicating a starting of supplying raw materials, and a speed Nb of said crusher mechanism indicating a cessation of supplying raw materials;

controlling an actual speed N of said crusher mechanism so that the actual speed N of said crusher mechanism coincides with said target speed Nm when said crusher mechanism is operated at a target speed Nm which has been set;

starting a supplying of raw materials to said crusher mechanism when said actual speed N is increased to said speed Na; and stopping the supplying of raw materials to said crusher mechanism when said actual speed N is reduced to said speed Nb;

thereby obtaining crushed substances of a desired particle size distribution.

10. A method in accordance with claim 9, wherein each target speed Nm, each speed Na, each speed Nb, and each actual speed is a rotational speed.

11. A method in accordance with claim 9, wherein said crusher mechanism comprises an impact crusher mechanism.

12. A method in accordance with claim 9, wherein said crusher mechanism comprises a jaw crusher mechanism.

13. A method in accordance with claim 9, wherein said step of setting at least one target speed Nm comprises:

setting a plurality of target speeds Nm; and selecting any one of said plurality of target rotational speeds Nm for controlling an operation of said crusher mechanism.

14. A method in accordance with claim 9, wherein said step of setting at least one target speed Nm comprises:

setting a low target speed, a medium target speed, and a high target speed; and selecting any one of the thus set target speeds for controlling an operation of said crushing mechanism.

* * * * *

UNITED STATES PATENT AND TRADEMARK OFFICE

CERTIFICATE OF CORRECTION

PATENT NO. : 5,833,150

DATED : November 10, 1998

INVENTOR(S) : Koyanagi, et al

It is certified that error appears in the above-identified patent and that said Letters Patent is hereby corrected as shown below:

Column 9, line 62, after "A" delete --mobile--

Column 9, line 65, after "A" delete --mobile--.

Column 12, line 2, after "target" delete --rotational--.

Signed and Sealed this

Twenty-third Day of February, 1999

*Attest:*

Q. TODD DICKINSON

*Attesting Officer*

*Acting Commissioner of Patents and Trademarks*